US006380860B1

(12) United States Patent
Goetz

(10) Patent No.: US 6,380,860 B1
(45) Date of Patent: Apr. 30, 2002

(54) PORTABLE WIRELESS CELLULAR FIRE ALARM SYSTEM APPARATUS AND METHOD

(76) Inventor: Joseph R. Goetz, 550 E. Encinas Ave., Gilbert, AZ (US) 85235

( * ) Notice: Subject to any disclaimer, the term of this patent is extended or adjusted under 35 U.S.C. 154(b) by 0 days.

(21) Appl. No.: 09/461,435

(22) Filed: Dec. 14, 1999

(51) Int. Cl.[7] ..... G08B 17/00

(52) U.S. Cl. ..... 340/586; 340/539; 340/693.5; 455/404

(58) Field of Search ..... 340/586, 693.5, 340/628, 539, 287, 288; 455/404; 379/37, 43

(56) References Cited

U.S. PATENT DOCUMENTS

| | | | | |
|---|---|---|---|---|
| 3,795,896 | A | | 3/1974 | Isaacs |
| 3,833,895 | A | | 9/1974 | Fecteau |
| 3,866,687 | A | | 2/1975 | Banner |
| 4,446,454 | A | | 5/1984 | Pyle |
| 4,523,184 | A | | 6/1985 | Abel |
| 4,560,978 | A | | 12/1985 | Lemelson |
| 4,628,152 | A | | 12/1986 | Akerberg |
| 4,661,804 | A | | 4/1987 | Abel |
| 4,742,336 | A | | 5/1988 | Hall et al. |
| 4,818,970 | A | | 4/1989 | Natale et al. |
| 4,904,983 | A | | 2/1990 | Mitchell |
| 4,943,799 | A | | 7/1990 | Papineau |
| 5,019,805 | A | | 5/1991 | Curl et al. |
| 5,070,320 | A | | 12/1991 | Ramono |
| 5,117,223 | A | * | 5/1992 | Tanner ..... 340/693.5 |
| 5,200,735 | A | * | 4/1993 | Hines ..... 340/539 |
| 5,210,785 | A | | 5/1993 | Sato et al. |
| 5,235,320 | A | | 8/1993 | Romano |
| 5,257,007 | A | | 10/1993 | Steil et al. |
| 5,283,549 | A | * | 2/1994 | Mehaffey et al. ..... 340/539 X |
| 5,319,698 | A | | 6/1994 | Glidewell et al. |
| 5,341,988 | A | | 8/1994 | Rein et al. |
| 5,361,985 | A | | 11/1994 | Rein et al. |
| 5,365,214 | A | | 11/1994 | Angott et al. |
| 5,385,297 | A | | 1/1995 | Rein et al. |
| 5,390,206 | A | | 2/1995 | Rein et al. |
| 5,412,297 | A | | 5/1995 | Clark et al. |
| 5,438,607 | A | | 8/1995 | Przygoda, Jr. et al. |
| 5,440,292 | A | | 8/1995 | Bedrosian |
| 5,515,419 | A | | 5/1996 | Sheffer |
| 5,517,553 | A | | 5/1996 | Sato |
| 5,526,401 | A | | 6/1996 | Roach, Jr. et al. |
| 5,546,444 | A | | 8/1996 | Roach, Jr. et al. |
| 5,565,844 | A | | 10/1996 | Bedrosian |
| 5,587,701 | A | | 12/1996 | Hess |
| 5,594,410 | A | | 1/1997 | Lucas et al. |

(List continued on next page.)

*Primary Examiner*—Thomas Mullen
(74) *Attorney, Agent, or Firm*—Jordan M. Meschkow; Lowell W. Gresham; Meschkow & Gresham, P.L.C.

(57) ABSTRACT

A portable wireless cellular fire alarm system is completely contained in a single rugged readily transportable suitcase. It is completely wireless and stores all components in the suitcase when not in use and is also completely portable taking only minutes to set up. The detectors of various types are removed from the case and positioned in the structure to be monitored each having its own short range 900 MHZ transmitter to wirelessly send alert signals to the receiver in the case located up to 1000 feet away. A long range cellular radio then transmits the signals wirelessly using the cellular control channel and to an MSC which wirelessly transmits them to the CMS, all using the MicroBurst™ protocol Remote Feature Control Request control channel transaction which effectively gives the unit nationwide roaming capability and functionality without any reprogramming. There is no user interface. The suitcase is watertight and airtight and a conspicuous bright orange color. The suitcase can be powered by A/C or run on its internal battery or both. A top mounted, removable antenna, is also located on the suitcase along with a female power cord socket.

12 Claims, 7 Drawing Sheets

U.S. PATENT DOCUMENTS 5,675,371 A 10/1997 Barringer
5,684,828 A 11/1997 Bolan et al.
5,710,728 A 1/1998 Danielson et al.
5,724,647 A 3/1998 Sato
5,752,917 A 5/1998 Fuchs
5,777,551 A 7/1998 Hess
5,793,290 A 8/1998 Eagleson et al.
5,822,423 A 10/1998 Jehnert et al.
5,832,394 A 11/1998 Wortham
5,833,134 A 11/1998 Ho et al.
5,844,824 A 12/1998 Newman et al.
5,850,180 A 12/1998 Hess
5,856,660 A 1/1999 Bard et al.
5,873,043 A 2/1999 Comer
5,889,474 A * 3/1999 LaDue ..... 340/825.49
6,049,273 A * 4/2000 Hess ..... 340/539

* cited by examiner

PORTABLE WIRELESS CELLULAR FIRE ALARM SYSTEM APPARATUS AND METHOD

CROSS-REFERENCES TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Fields of the Invention

The present invention relates generally to (1) a method of detecting and communicating an alarm condition to a remote manned central monitoring station which takes appropriate action, including dispatching personnel and equipment to deal with the situation and its related apparatus, and more particularly, to a completely portable and wireless method of detecting and reporting a fire rekindle and summoning emergency crews, and even more particularly to such a method and apparatus which reports the fire and alerts the remote central monitoring station and the local fire dispatch using the control channel of a conventional nationwide cellular phone network 2. Discussion of Background and Prior Art a. The Rekindle Problem

In a recent article by Gil Damiani, a battalion chief of the Mesa, Arizona Fire Department, entitled "An End To The Rekindle Nightmare", *Firehouse*, May 1999, the horror of a rekindle was accurately described. Chief Damiani related how an engine company responded to a kitchen fire at 1:30 P.M. Upon arrival the fire chief was told that the fire had been extinguished by the homeowner. The fire crew investigated. One member checked the attic and others checked the area around the fire. It was all clear with minimal damage. The crew returns to the station. Ten hours later, at about midnight, however, the Fire Department was again dispatched to the same address. This time, it was a fully involved attic. You had a rekindle!

As Chief Damiani pointed out, the fire service is always challenged to do its job effectively and efficiently. However, one shared concern among firefighters everywhere is the problem of rekindles.

Like many areas all over the country most of the newer homes in Mesa, Ariz. have vaulted ceilings that do not afford much room for firefighters to check for smoke or embers in attics. Id. However, there can be many other areas in a home, new or old, such as, recessed lighting fixtures, exhaust fans over stoves and chases around chimneys, to name just a few, that will also "hide" embers and allow them to grow into a roaring wall or attic fire. Id.

Fires in concealed spaces present unique problems with overhaul because homeowners object to the damage to the home, such as pulling down vaulted ceilings or ripping out kitchen cabinets, caused by fire crews looking for burning embers so that the crew does not have to return at 3:00 A.M. Id. As Chief Damiani stated:

"It's a Catch-22: completely open the walls and ceilings to thoroughly check, even though the fire appears out (this subjects the fire department to criticism by customers or insurance adjusters); or open them up only minimally and take the risk of a rekindle, even though the chances are remote that a rekindle will occur. If you have ever responded to a rekindle, you are well aware of the time, energy, resources, liability and embarrassment that comes with it—to say nothing of the hazards to life and property,". Id.

There is one alternative solution to the "thorough check" versus "minimal opening" dichotomy presented by Chief Damiani particularly where the rekindle risk is in a commercial building. The Fire Department can post a fire watch at the location of the "extinguished" fire comprising a fire watch person and fire truck parked at the scene for many hours to wait for a possible rekindle. This solution is obviously unsatisfactory due to the high costs in personnel and equipment.

Accordingly, it is an object of the present invention to completely and inexpensively eliminate the rekindle problem by providing a completely portable and wireless fire alarm system that can be readily positioned in minutes for temporary use in homes or commercial buildings where rekindles are a risk.

The "rekindle" problem described above is a close cousin to the "intruder" problem that has thwarted security system solutions for years despite advances in technology, as described in greater detail below.

b. The Inoperative Or Unavailable Permanent Fire Alarm System Problem

As is often the case the permanent fire alarm system in a building is down for parts or maintenance. Almost universally, a commercial building cannot be occupied without a working fire alarm system unless a fire watch person is posted at the scene.

Similarly, a commercial building that does not have or does not yet have an installed permanent fire alarm system is often scheduled for use for a special event, but is declined a use permit since there is no permanently installed fire alarm system.

Accordingly, it is an object of the present invention to totally eliminate the temporarily inoperative or totally absent fire alarm system problem by providing a completely portable and wireless fire alarm system that can be readily positioned in minutes for temporary use in such buildings and which meets all fire code regulations and will be acceptable to the Fire Department.

c. Prior Land Line Alarm Systems

There were many early solutions to the problems described above, but each was unsatisfactory for a variety of reasons.

In a system by Hall in U.S. Pat. No. 4,742,336 there is disclosed a portable intrusion detection, monitoring and alarm system housed in an ordinary carrying case resembling a conventional suitcase or briefcase providing a partially portable system readily placed near a space to be monitored. The wireless infrared motion intrusion detectors are removed from the case and placed about the space to be monitored and transmit a detection signal to a receiver in the carrying case which delivers the signal to a digital communicator/dialer which captures a land telephone line by dialing and sends coded signals to a monitored central station for corrective action. See also Papineau U.S. Pat. No. 4,943,799 and Steil U.S. Pat. No. 5,257,007. However, smart criminals know how to cut the land line to disable this alarm system and in the case of a fire alarm system an operative land phone line is often not available just when it is needed.

Accordingly, it is an object of the present invention to completely and inexpensively eliminate the unavailable land line problem by providing a completely portable and completely wireless fire alarm system that can be readily positioned in minutes for temporary use in homes or commercial buildings where land phone lines are not available or are inoperative.

d. Prior Short Range Wireless Alarm Systems

Another early solution by Tanner in U.S. Pat. No. 5,117,223 disclosed a combination portable alarm system and storage container for parts thereof for use at construction sites or the like wherein the portable smoke detectors were positioned on a stanchion supported atop a portable cabinet positioned in the space to be monitored and could transmit an alarm signal via a voice channel of a wireless cellular radio to an answering cellular station which then notified a central monitoring station. However, this system failed to provide both short and long range transmission capability necessary to efficiently handle the multi-various conditions of the problems referenced above, and also would totally fail to report the alert if the voice channel was busy.

Accordingly, it is an object of the present invention to completely and inexpensively eliminate the short range and long range communications concerns of the aforesaid problems by providing a completely portable system with wireless short range transmitters for the detectors and companion devices and a long range wireless cellular transmitter for alerting the central monitoring station while avoiding any busy signal on the selected cellular channel and that can be readily positioned in minutes for temporary use in homes or commercial buildings where the aforesaid problems exist.

e. Prior Partially Portable Systems

In yet another early solution by Hines to the "close cousin intruder problem" described above in U.S. Pat. No. 5,200,735 there is disclosed a mobile security system including plural remote condition responsive sensor units (motion, intrusion, loop heat, water, etc.) which wirelessly transmit detection signals to a master control unit which receives the signals and transmits a signal to a remote alarm unit at the scene to sound an audible alarm or to alert a guard of the intruder's presence or other sensed condition or can dial a phone number or activate a cellular phone to make a report. There is also a provision for a long range transmitter to send a signal to a remote second master control to report. While each unit of this system is contained in its own weatherproof housing, there is no disclosure or suggestion of a single carrying case that houses all of the units when not in use to provide a degree of portability not envisioned or achievable by Hines.

Accordingly, it is an object of the present invention to completely and inexpensively eliminate the aforesaid problems of the this prior art by providing a single enclosure housing all of the components of the system when not in use thereby providing a completely portable and wireless fire alarm system that can be readily positioned in minutes for temporary in use homes or commercial buildings where rekindles are a risk.

f. Prior Portable, Wireless, Cellular Security Systems Using Cellemetry™ Control Channel Protocols Recent systems by Hess in U.S. Pat. Nos. 5,587,701, 5,777,551, and 5,850,180, focus on the close cousin "intruder" problem alluded to above but fail to suggest the important aspects and features of the present invention.

Hess first disclosed in Sep. 9,1994 in U.S. Pat. No. 5,587,701 a partially wireless, or voice channel wireless, short range/long range, cellular, intruder security system all self contained in a portable, shatterproof, shock resistant, polyurethane enclosure ('701 specification at 2:42–55) resembling an inconspicuous, unobtrusive, and innocuous-looking "stereo/CD boom box" ('701 specification 2:29–41), and also requiring a programmable key pad as a user interface, in which wireless security contacts (motion, sliding contacts) placed at points of entry communicate detection signals short range to the receiver/controller in the portable enclosure which notifies a central monitoring station via a land telephone line, or a wireless 800 MHZ trunk frequency, or a conventional 900 MHZ cellular voice channel frequency.

Hess next disclosed on Sep. 23, 1996 in U.S. Pat. No. 5,777,551, while continuing to focus on the much less disciplined "intruder" problem, that the security contacts could include "a smoke detector" ('701 specification at 1:40, but no discussion of detecting and reporting fires), and that his system is wireless, that is, the system requires no wires (i.e., wireless 1), and that the system is cellular (i.e., wireless 2) ('701 specification at 2:12–21).

Finally, Hess next disclosed on Jul. 2, 1997 in U.S. Pat. No. 5,850,180, while still focused on the "intruder" problem, that the cellular phone can initiate a call on a frequency of 900 MHZ over the control channel of the cellular phone system using Cellemetry™ protocols ('180 specification at 7:13–8:63), and, in a single sentence devoted to fire detection, states that the detector's actuating the receiver to contact the monitoring station complies with commercial fire code standards.('180 specification at 6:27–29).

However, nowhere does Hess disclose or suggest (1) a highly disciplined fire alarm system, or (2) a key-pad-less system, or (3) the use of the more efficient MicroBurst™ protocols in implementation of the control channel calls by the cellular phone when processing fire alarm signals enabling the suitcase to be instantaneously positioned any place in the United States and function properly without any reprogramming, or (4) the use of a rugged watertight, airtight case for fire detection applications.

Accordingly, it is an object of the present invention to completely and inexpensively eliminate the aforesaid problems of the prior art by providing a single, nation-wide-roamable-without-reprogramming, rugged, watertight, airtight, enclosure housing all of the components of the system when not in use thereby providing a completely portable and wireless fire alarm system using MicroBurst™ control channel protocols to report fire alarms without the need for a user interface and that can be readily positioned in minutes for temporary use in homes or commercial buildings and at other events where rekindles are a risk or temporary fire detection is a requirement but is unavailable.

Applicant hereby incorporates by reference all of the disclosures set forth in Hess U.S. Pat. Nos. 5,587,701, 5,777,551, and 5,850,180 in their entirety as if set forth verbatim herein.

Thus, there is not in the marketplace today, but there is a present need for, a nation-wide-roamable-without-reprogramming portable fire alarm system which includes in combination a plurality of multiple fire detection devices of various types, each independently positionable within a structure to be monitored and capable of making short range wireless transmissions of detection or alarm signals to a nearby portable receiver connected to a wireless long range cellular phone, all of the above when not in use installed in a rugged, watertight, portable suitcase and carried easily on a fire truck for deployment anytime temporary fire detection is needed, the cell phone transmitting the alert signal over the control channel of the cellular network, using the MicroBurst™ protocols, to a remote, distant, central monitoring station which notifies the authorities.

BRIEF SUMMARY OF THE INVENTION

Set forth below is a brief summary of the invention which achieves the foregoing and other objects and provides the foregoing and hereafter stated benefits and advantages in accordance with the structure, function and results of the present invention as embodied and broadly described herein. Applicant's invention includes independently both the apparatus and the methods described herein which achieve the objects and benefits of the present invention. Both formats of the invention are described below, and it is applicant's intention to claim both formats even though from time to time below for purposes of clarity and brevity applicant will use either one or the other format to describe various aspects and features of the invention.

The Portable Wireless Fire Alarm System is completely contained in a suitcase. It requires no wires to communicate with a Central Station and no wires for the remote smoke detectors, pull stations, heat detectors or water flow devices to communicate with the suitcase. When a temporally Fire Alarm reporting system is needed this portable system can be put into service in a matter of minutes. The system operates by placing wireless smoke detectors, pull stations, heat detectors, and water flow detectors in the building requiring temporary protection. The suitcase contains a radio transmitter that is designed to communicate with a Central Dispatch Station and a radio receiver that is designed to receive signals from the smoke detectors, pull stations etc. Any detector that senses a fire will immediately send a signal to the receiver in the suitcase which will in turn transmit a fire signal to the Central Station. The suitcase can be powered by A/C or run on its internal batteries or both. A top mounted, removable antenna, is also located on the suitcase.

Advantages

The advantages of the present invention are numerous. The system

1. Is completely portable.
2. Is transportable in its own self contained suitcase.
3. Is easily transported on any fire truck or in the trunk of a supervisor's vehicle.
4. Is readily put into service in minutes.
5. Can be easily placed in a structure immediately after a fire to immediately notify your Fire Dispatch of a rekindle.
6. Readily detects rekindles in structure fires, particularly in concealed spaces with difficult overhaul.
7. Is completely wireless in that both local and long distance alarm reporting can be effected without phone lines or A/C power.
8. Is completely wireless in the sense that all transmissions from the detectors to the final central monitoring station can be made by short range wireless radio (detector to carrying case receiver) and by long range wireless cellular control channel (carrying case cellular transceiver to nearest cellular site to the Mobile Switching Center ("MSC") and/or to the Central Monitoring Station ("CMS")) completely effecting reporting without using the phone lines, A/C power, or the Public Switching Telephone Network ("PSTN").
9. Can be moved to any place in the continental United States and remain completely functional by detecting the fire and alerting its originally assigned central monitoring station without any reprogramming in mere seconds.
10. Does not require the Fire Department to buy any equipment to monitor the incoming alarm signals.
11. Charges its assigned central monitoring station only for the cellular calls it makes, completely eliminating regular fixed monthly charges at great savings.
12. Stores its smoke and heat detectors in its own case so that they are always available and ready for use.
13. Provide continuous protection in existing construction during permanent fire alarm system repair or remodeling.
14. Allows a business in new construction to temporarily occupy a building pending approval of the final fire detection system.
15. Can be used in a temporary structure for short term special events when otherwise a fully operational fire alarm system would normally be required.
16. Is expandable to 16 detection or companion devices.
17. Is easily displayed at civic events or in classroom setting for training and building good will.
18. Provides both safety and good public relations.

BRIEF DESCRIPTION OF THE SEVERAL VIEWS DRAWINGS

DETAILED DESCRIPTION OF THE INVENTION

A. General Purpose

Figure 1:
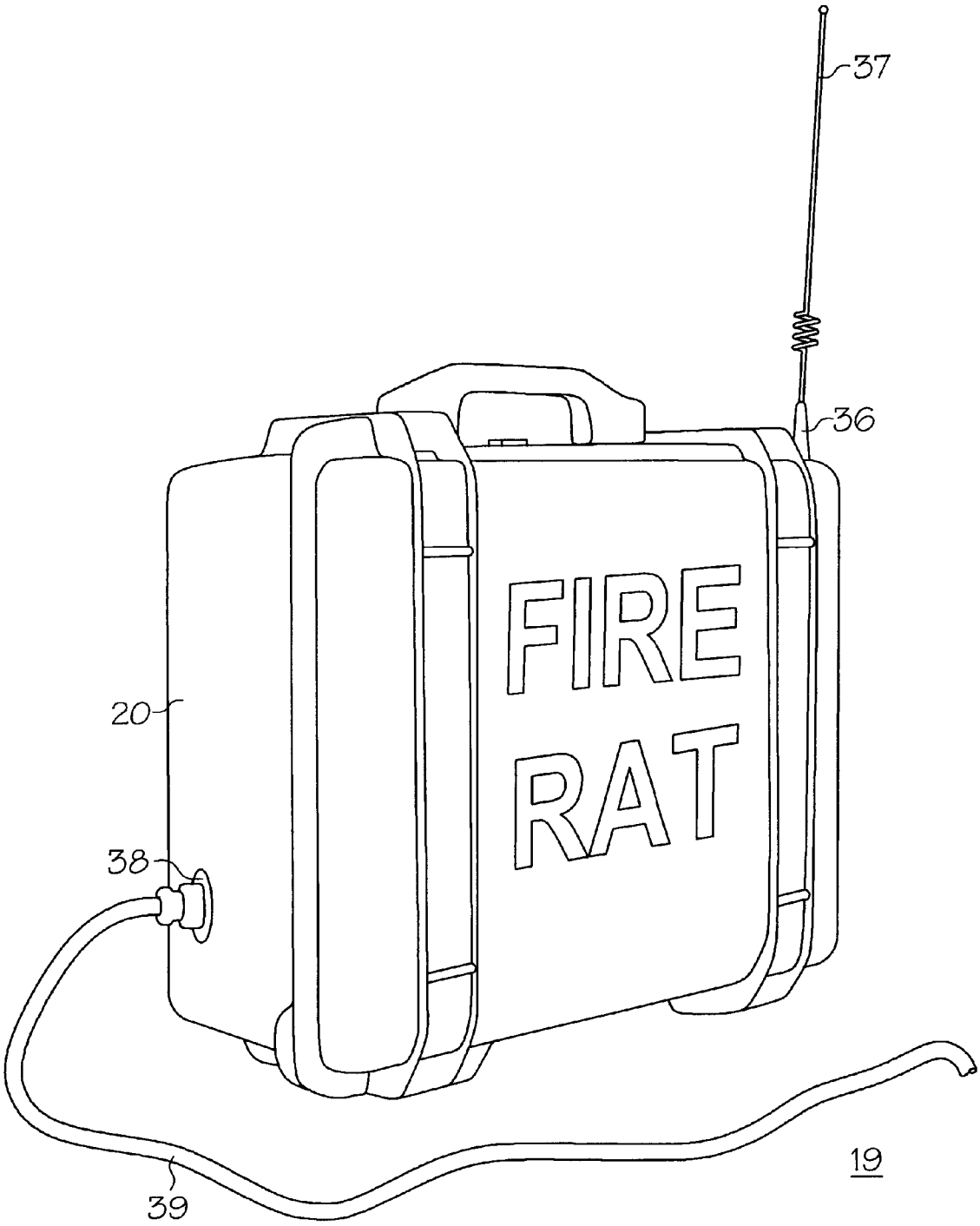
FIG. 1 is a perspective view of a portable wireless alarm system of the present invention.
Figure 2:
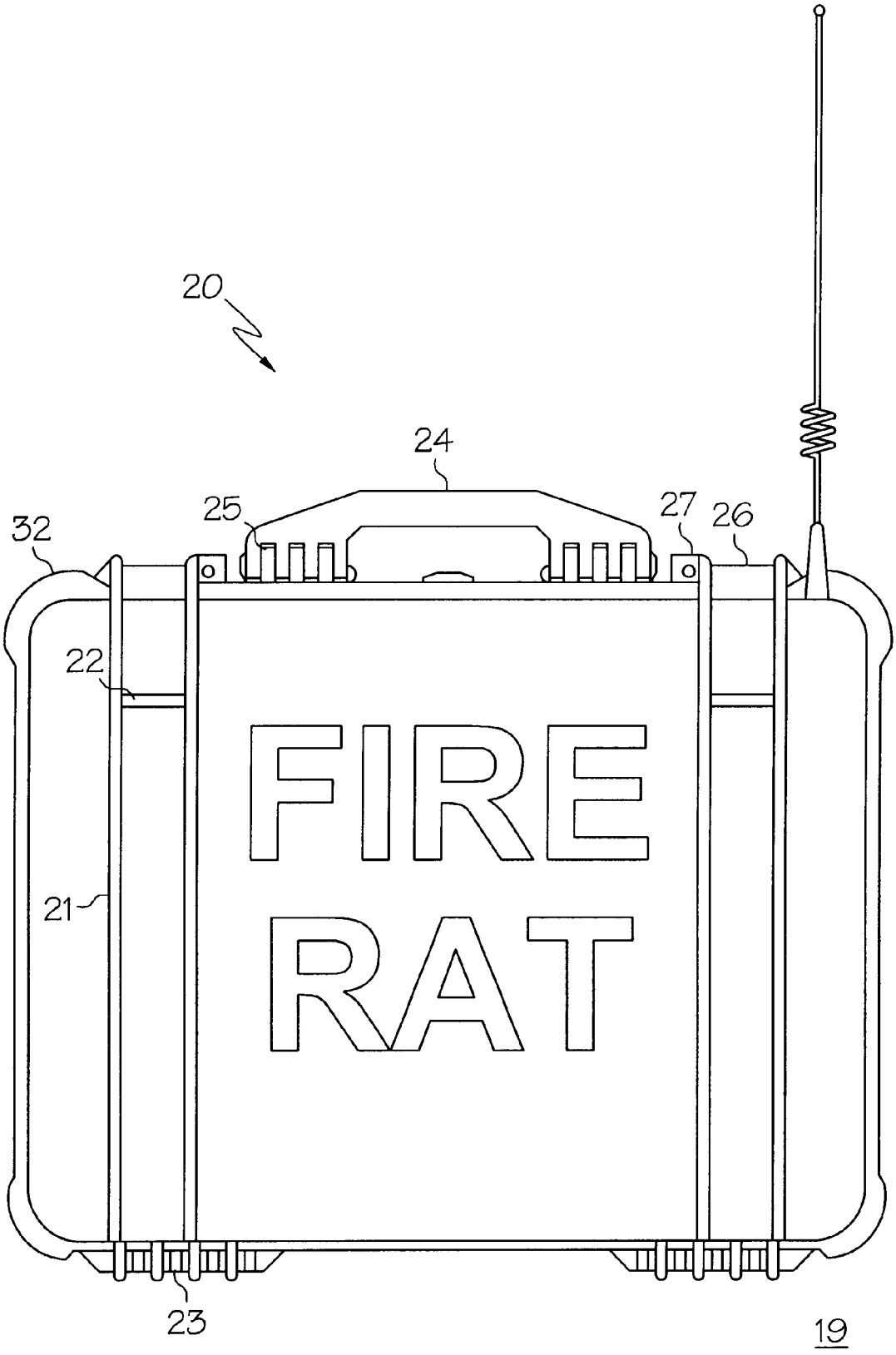
FIG. 2 is a front elevation view of the present invention showing the applicant's trademark applied to the product.

Referring to FIGS. 1 and 2, FIG. 1 shows a perspective view of a portable wireless firealarm system 19 of the present invention. FIG. 2 shows a front elevation view of the applicant's trademark applied to system 19. RAT™ is the trademark that applicant applied to the portable wireless fire alarm system product of the present invention and is the acronym for Radio Alarm Transmitter.

The portable RAT system 19 was designed and built to address the age old problem of "undetected rekindles" in structure fires, particularly in concealed spaces with difficult overhaul.

Prior to the present invention, when a structure fire occurred, a decision was made as to whether to leave a truck and several firemen at the site for a predetermined and often lengthy period of time to detect any rekindle which might occur at the site. This practice, still in widespread use today, is obviously extremely costly in terms of manpower, equipment and financial outlay.

The portable RAT system 19 was conceived for the purpose of enabling inexpensive, but effective, remote electronic monitoring of a site for rekindles by placing a completely wireless portable detection and reporting apparatus at the site coupled to the remote monitors thereby totally eliminating at great savings of time, money, and effort the need to station expensive equipment or personnel at the site for that purpose.

This portable wireless fire alarm system 19 of the present invention can be carried in a suitcase and set up in a matter of minutes. It's included internal battery pack will operate for over 40 hours between charges. The system 19 works on A/C power if available or completely on batteries if outside power is not available.

What makes this system 19 so special is that it is completely wireless and completely contained in one suitcase making it completely portable.

B. System Components

1. Rugged Water/Air Tight Carrying Case

The carrying case 20 (FIGS. 1 and 2) is a modified off the shelf Model 1550 protector case made by Pelican Products of Torrance Calif. It is made of an unbreakable plastic material and is advertised as "The World's Toughest, Unbreakable, Watertight, Dustproof Equipment Case" and comes with an unconditional lifetime guarantee of excellence. The case 20 has a pair of ribs 21 which encircle the entire case 20 near each side edge with periodically spaced crossbar reinforcements 22. The case 20 is supported upright on a plurality of sturdy feet 23. The handle 24 is hinged 25 to lay flat against the top wall during shipment.

Figure 4:
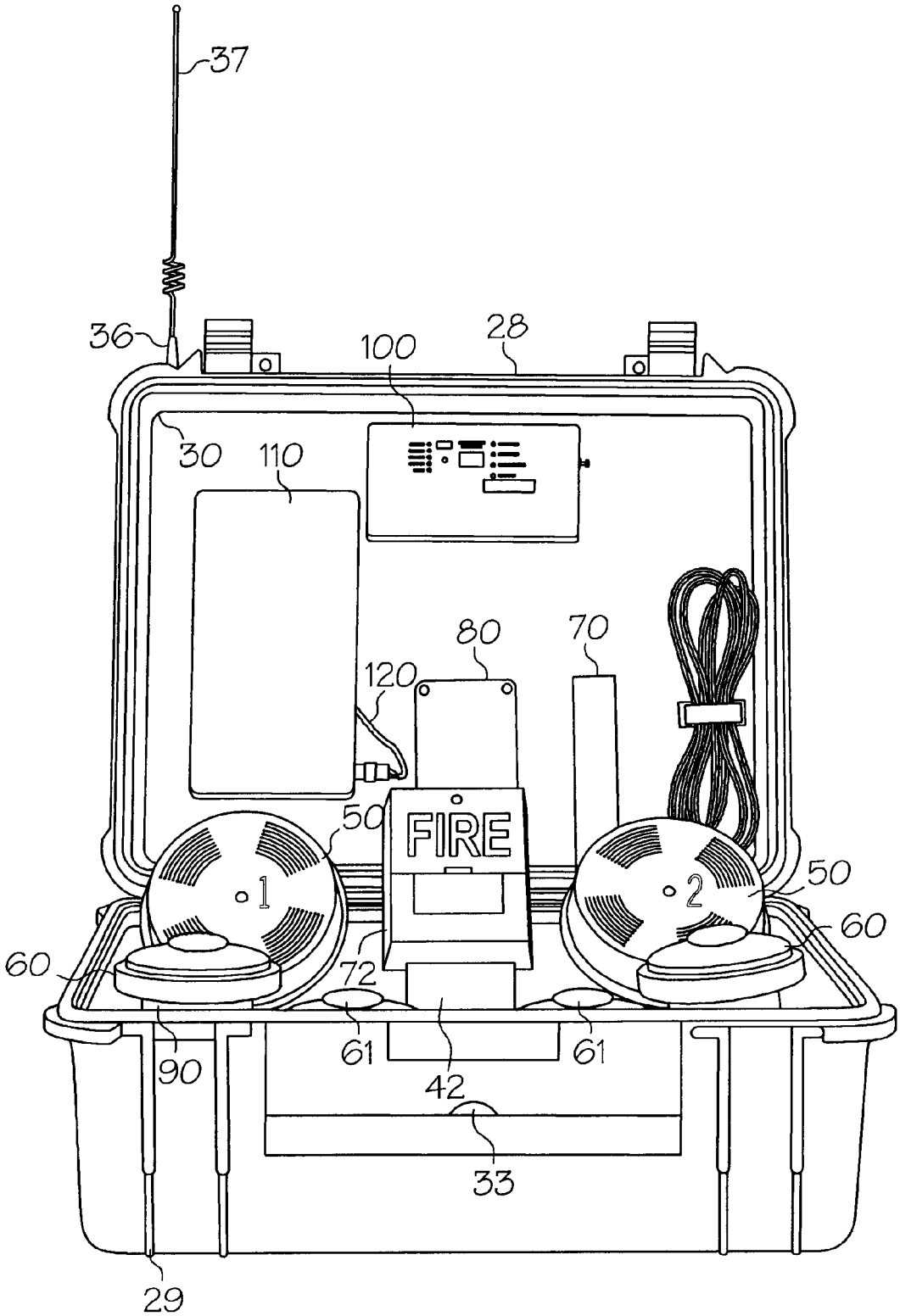
FIG. 4 is an elevation view of the second utilitarian and preferred embodiment of the present invention which is a wireless cellular version of the present invention self contained in a rugged, watertight, airtight case.

Referring to FIG. 4 in connection with FIGS. 1 and 2, a pair of hinged latches 26 lock the lid 28 and base 29 and fold into the space between the ribs 21 to prevent inadvertent unlatching during shipment. As a further safeguard, a pair of sturdy lock lugs 27 also extend from the top wall to receive locks to prevent opening during shipment. The lid 28 is fitted with a rubber seal 30 in a groove in the underside of lid 28 throughout its entire circumference which forms a watertight and airtight seal when the lid 28 and base 29 are latched closed. The lid/base structure at the seam is formed as a sturdy rib 32 extending laterally from the lid and base walls around the entire periphery of the case and being somewhat more bulbous at the four corners. This structure obviously provides a great deal of strength to the entire case 20. Also on the top wall is a pressure control 33 which allows release of the vacuum which builds up in the case during decreases in altitude. Otherwise, the case 20 could not be opened due to its air and water tightness. The interior of the case 20 is provided with black foam pre-cut into little squares which can be removed one at a time to allow the case to be customized to receive customer's components.

Applicant has modified the case 20 to provide a male antenna post 36 sealingly extending through the top to which a 900 MHZ antenna 37 attaches. An alternative female socket 37 (not shown) for a mating antenna (not shown) may also be used. A female power cord socket 38 has been sealingly provided through the lower left portion of the left side wall of the case 20 to receive the 110 volt power cord 39. The power is stepped down by to 12 volts A/C by a transformer mounted internally in the case. An LED has been provided through the lower left portion of the right side wall to indicate A/C power is being applied and the battery is charging. When A/C power is not available, the RAT system 19 may be operated on its two internal rechargeable 7 amp hour batteries 42 which can provide 28 hours of system operation. When not in use, the power cord 39 and antenna 37 are stored inside the case 20 wrapped in a hook and loop fastener.

The carrying case 20 has been provided with a bright orange color to make it very distinct, conspicuous, and obvious.

As an option, the carrying case 20 may be provided with a Knox key to turn on the power. A Knox key is a non-reproduceable key held by only the Fire Department and ensures that only Fire Department personnel will be able to open the carrying case and enable and operate the system 19. When this option is selected, the power switch (not shown) is located on the outside of the case 20 near the handle 24. When a 110 volt source is not available, the Knox key is inserted into its slot and the power switch is turned on. When A/C is not being used, the operator must wait 30 seconds for the A/C trouble alarm to activate on the red fire panel display. The alarm may be silenced by pressing the button on the top left corner of the Fire Controller. 7720 ULF Fire Control Panel (900 MHZ)

2. The Smoke Detectors.

Figure 5:
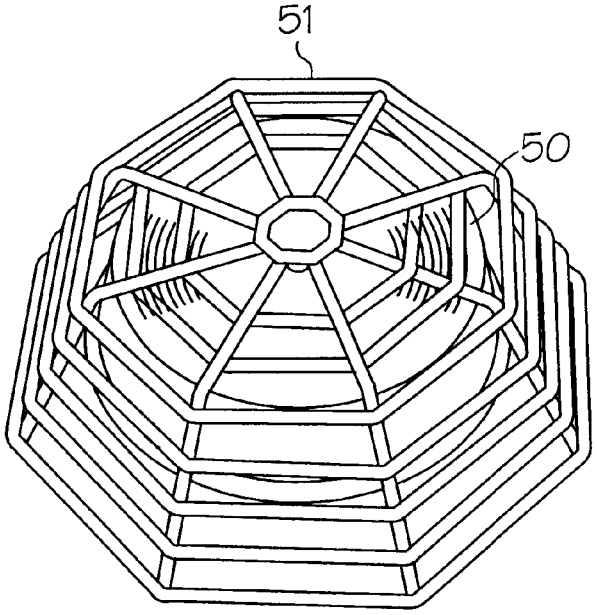
FIG. 5 is a perspective view of a smoke detector in a protective cage of the present invention.

The RAT system 19 comes with 3 wireless smoke detectors 50, of which only two are shown in FIG. 4. Smoke detectors 50 are model FA201 made by Inovonics and each uses 2 Duracell 9-volt alkaline batteries. The detectors 50 when not in use are carried in the carrying case 20. In use, the detectors 50 sense smoke and will send an alarm signal to a 16 channel receiver 100. Each smoke detector 50 is connected to a Standard Inovonics short range transmitter Model FA210 90, described in greater detail below, and an associated end-of-line resistor (EOL) 63, also described in greater detail below. Optionally, the smoke detectors 50 may be protected against damage by being placed in a safety cage 51 (FIG. 5) when in use.

3. The Heat Detectors.

Figure 6:
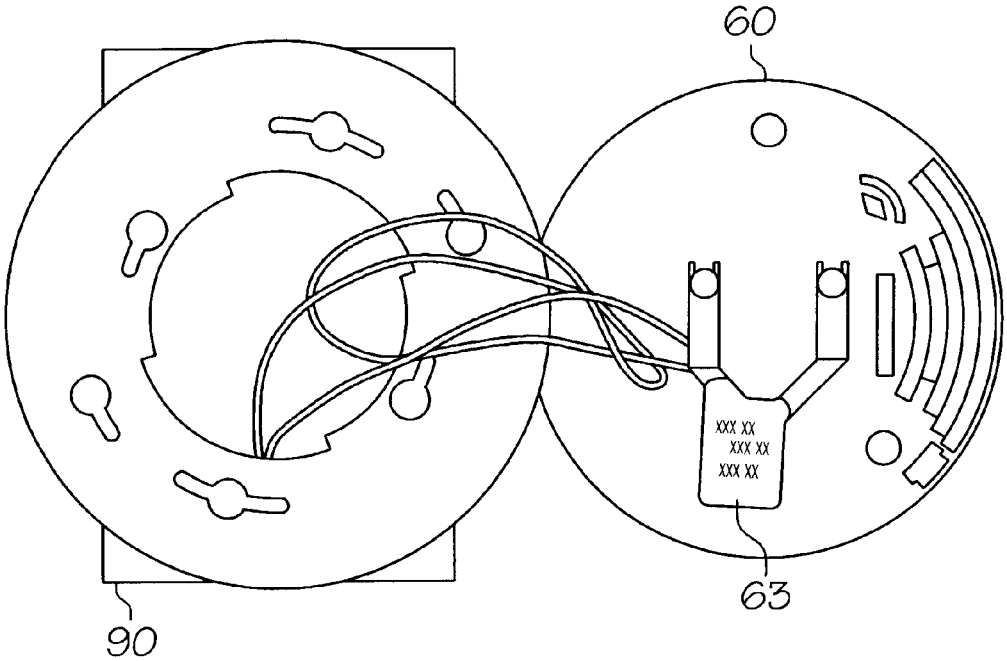
FIG. 6 is a plan view of a partially disassembled heat detector showing the end-of-line resistor ("EOL") and underlying 900 MHz short range (1000–2500 feet) wireless transmitter of the present invention.
Figure 7:
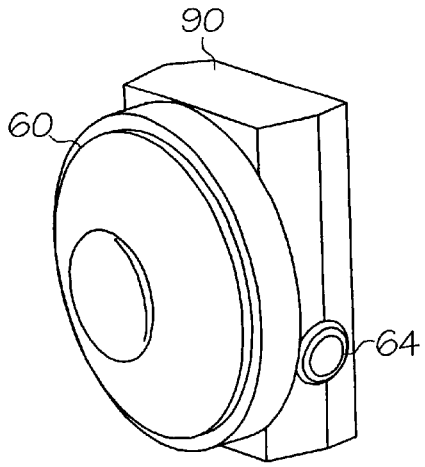
FIG. 7 is a perspective view of a heat detector with associated short range wireless transmitter and test button of the present invention.

The RAT system 19 comes with two Chemetronics heat detectors 60 (FIGS. 4, 6, 7), and two spare heads 61. The two detectors 60 are each a Model CC135 made by Inovonics. The two spare heads 61 are each a Model CC-A200. The spare heads 61 are provided because once a heat detector head 61 senses heat and issues an alarm, it is no longer usable. As seen in FIG. 6, each heat detector 60 is connected to a Standard Inovonics short range transmitter Model FA210 90, described in greater detail, below and an associated EOL 63, also described in greater detail below. Heat detectors 60 do not sense body heat as described in the intruder security systems of the Hess prior art patents, but rather, are designed to sense the heat associated with a fire.

Each heat detector 60 is provided with a test button 64 which simulates heat of a fire for test purposes without risk of ruining the sensor.

As mentioned above, each detector/station/alarm device is connected or coupled to a wireless, short range transmitter which is preferably directly mounted on a common support with the detector/station/alarm device. When an alarm condition is sensed by a detector/station/alarm device, the alarm signal is relayed to the short range transmitter mounted on or supported by and coupled to the unit for transmission to the portable fire controller in the case 20, as described in greater detail below.

4. The Water Flow Detector and Fire Pull Stations.

Figure 8:
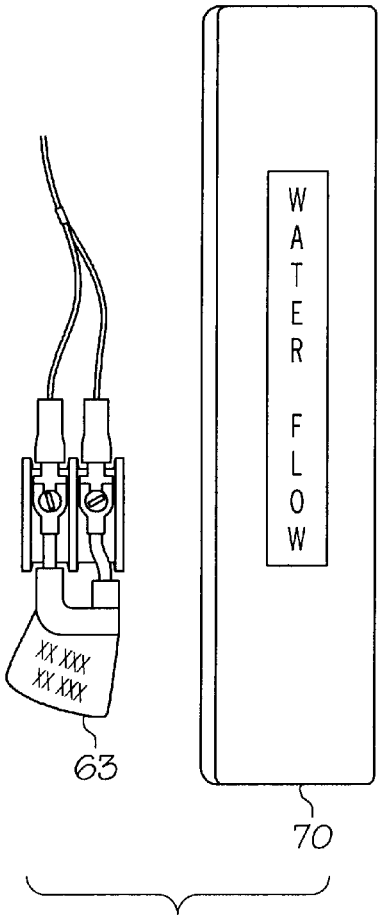
FIG. 8 is a plan view of a water flow detector with 900 MHz longer short range (10,000 feet) transmitter and associated EOL of the present invention.

An optional item is the water flow detector 70 shown in FIG. 8 and its associated EOL 63, described above. The water flow detector 70 is a tamper switch in that it is put on a normally open line to allow a determination of a change in state of the line. The water flow detector 70 attaches via wires (not shown) to the building's water flow switch and sends an alarm signal if the water flow detector 70 closes indicating water flow in the sprinkler system, and, therefore, a fire. Also provided is one fire pull station 72. Each of these devices is connected to a short range wireless transmitter 90, as described in greater detail below.

5. The End Of Line Resistors.

The EOL resistor 63 (FIGS. 6 and 8) works the same way on all of the detectors. An EOL 63 is provided on each smoke detector 50, heat detector 60, water flow detector 70, fire pull station 72, and tamper switch 80. The EOL 63 is a very large resistor that is placed in parallel across a normally open switch. It thereby couples the open lines together completing the circuit. However the EOL resistor 63 is so large that only a small trickle current flows in the normally open circuit. This trickle current is large enough, however, to be seen by the short range transmitter 90. So long as the trickle current is flowing, no alarm signal is triggered. If a fire occurs and the normally open switch closes, a code 1 "fire alarm" signal is transmitted. If the line breaks, the radio sends a code 2 "trouble" alarm. Code 3 alarm is reserved for a Low Battery alarm.

The EOL 63 differentiates a fire alarm system from a security system and reflects the much higher discipline of the former. The EOL 63 in the present invention monitors the ready status of the lines. A fire system operates on normally open contacts whereas a security system operates on normally closed contacts. Thus, in a fire system a broken line causes a "trouble alarm" not a "fire alarm", whereas in a security system, a broken or open wire is reported as a burglary. The fire system is always active, whereas the security system needs to be armed to operate. Thus, in the present invention the detectors supervise themselves for trouble, low battery and tamper.

6. The Short Range 900 MHZ Transmitters.

The wireless transmitters 90 carried by, supported on, or coupled to the detector/station/alarm mechanisms, i.e. heat detector 60, operate on a radio frequency of 900 MHz. The electromagnetic radio waves at this frequency have the ability to penetrate walls of concrete and steel and have a line of sight range of not less than about 1000 feet and a maximum of about 2500 feet. Longer short range transmitters for the detector/station/alarm devices are available with a line of sight range of 10,000 feet. The shorter short range transmitters 90 of the present invention are Standard Inovonics Model FA210 transmitters. The longer short range transmitters of the present invention are High Power Inovonics Model FA200 transmitters. Water flow detector 70 is one such longer short range transmitter.

Each detector and pull station is polled every 15 minutes by the microprocessor in the fire controller. If any such device fails to report in or has a low battery, its identity is determined and stored in the fire controller's memory, and a report is generated and sent to the central station. All components in the portable system are thus continuously supervised including the wireless, high power transmitter which also reports in every 15 minutes to the central station to acknowledge its readiness.

The devices in the case 20, smoke detectors 50, heat detectors 60, etc. are always active and will send a signal to the 16 channel receiver 100 whenever a trouble or alarm occurs.

All devices are supervised in several ways. The receiver 100 will detect and transmit to the central station any problem it detects from any of the detectors. This includes inactivity, low battery, tamper and alarm. Detectors are also supervised with EOL resistors 63. A loose wire or improperly connected switch will generate a "trouble" alarm. The receiver 100 will store all information until powered down or reset. Since all devices are supervised, any unused device must be left in the case or it will be reported missing.

7. The 16 Channel Digital Radio Receiver.

The 16 channel digital radio receiver 100 (FIG. 9) is an Inovonics Model FA416DR receiver. It receives the data signals from the detector/station/alarm devices and relays them internally to the fire control panel. It can handle both wired and wireless devices. In the present invention, all wireless detectors and stations are preferred.

8. The Long Range Cellular Transceiver.

The long range cellular transceiver 110 (FIG. 9) is a Model 7832C cellular control channel receiver made by Ademco. It receives the data information from the digital receiver 100, generates a data packet containing coded information and transmits the packet over the control channel using the MicroBurst™ protocols (as distinct from the Cellemetry™ protocols), as described in greater detail below, to the nearest cellular tower 130. The cellular tower 130 transmits the information to an MSC (not shown) which sends the information to a digital receiver 151 of a central monitoring station (CMS) 150. Alternatively, cellular tower 130 transmits the information directly to the digital receiver 151 of CMS 150. Equipment is in place at the CMS 150 to decode the data packet and notify the local area Fire Dispatch of the fire. All of these communications, except the final telephone call from the CMS 150 to the local area Fire Dispatch are by wireless cellular control channel and are automatic and instantaneous, as described in greater detail below. Of course other communication links may be used as alternatives or backups, but are not primary or preferred in the present invention which utilizes solely the automated cellular control channel and MicroBurst™ protocols.

11. The Recharging Circuit

Internally mounted in the RAT carrying case 20 (FIG. 4) is a recharging circuit 120 which recharges one of the two batteries 42 when the battery 42 is not in service so that the batteries are maintained constantly at the ready.

C. Operating Process Steps

1. Set Up and Operation

1. Notify Local Fire Alarm Dispatch Center that the portable wireless fire alarm system 19 is being placed in service and will be in the test mode for a few minutes. Ask the Alarm Dispatch Center to notify you whenever the central station calls to report an alarm.

Figure 3:
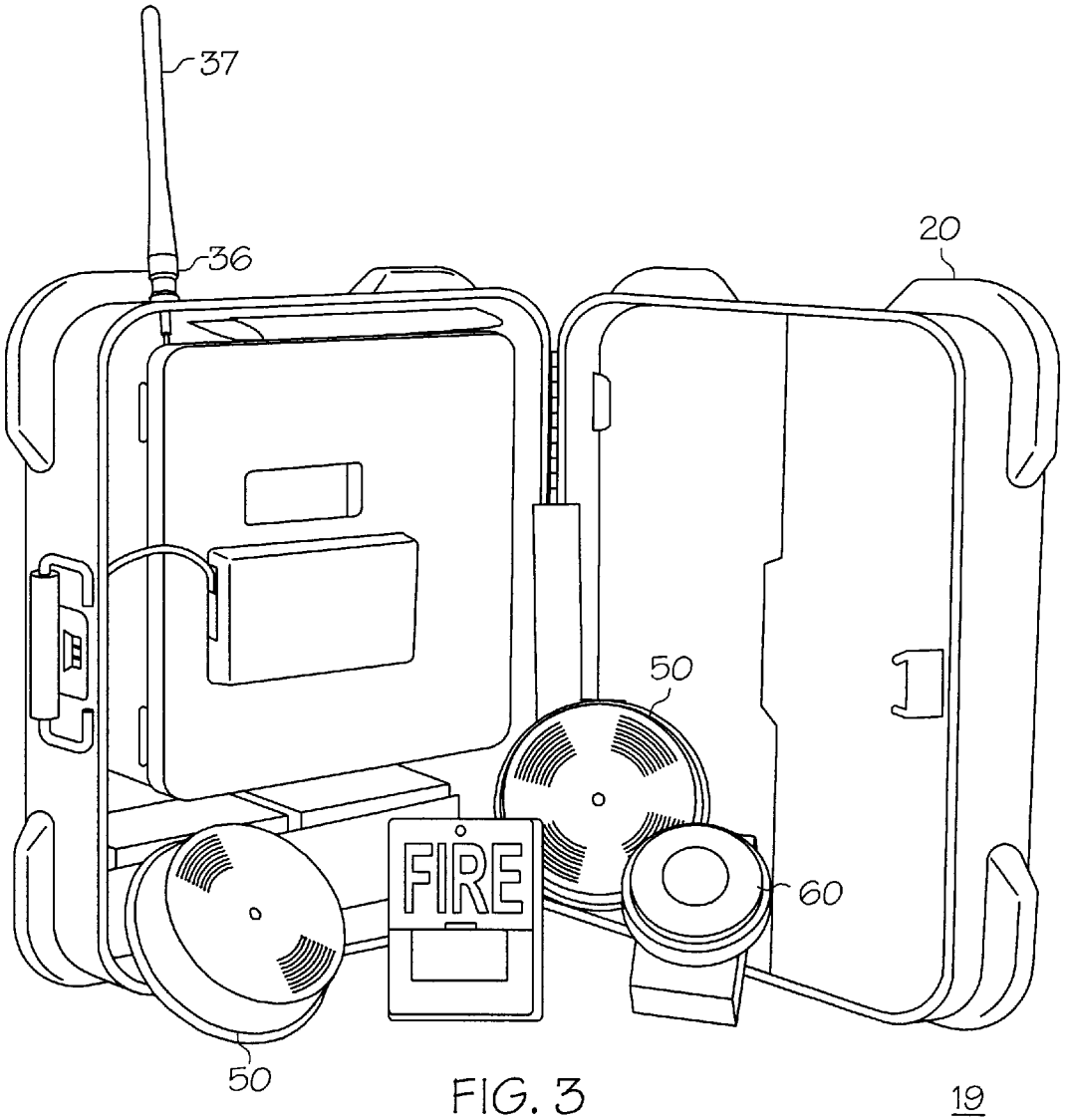
FIG. 3 is an elevation view of the first utilitarian embodiment of the present invention which was a wireless non-cellular version of the present invention self contained in a rugged non-watertight, non-airtight case.

2. Place the carrying case 20 (FIG. 3) as high as possible for optimal antenna operation and radio transmissions. The case 20 can be set up in the same building or up to one thousand feet away in another structure. If A/C is available, plug the system into a 110 v wall outlet. If not, the battery will operate the RAT portable wireless fire alarm system 19 for 36 hours.

3. Open the case 20.

4. Use a Knox key to turn on the power if the case 20 is so configured. The power switch is located on the outside of the box near the handle. When a 110 volt source is not available, just turn on the power switch. When A/C is not being used, the user must wait 30 seconds for the A/C trouble alarm to activate on the red fire panel display. Press the top left button to silence it.

5. Place the detectors/devices in the building areas you wish to monitor. Smoke detectors 50 should be placed six to ten inches from the ceiling or in an attic space. The heat detector 60 may be useful when ambient smoke prevents the use of a smoke detector 50. The rekindle potential may be monitored by placing the heat detector 60 over any area where heat build up is of concern. Test each device (smoke and heat detectors) individually by pressing the button on each device to confirm that:

the system 19 received the device signal and that the system 19 successfully communicated with the central monitoring station ("CMS") 150 and that the CMS 150 called the local Fire Alarm Dispatch Center to report the alarm indication.

6. Test each device separately. If the system 19 receives the device signal, it is indicated at the panel and will indicate which zone was tripped. After the local Fire Alarm Dispatch Center confirms that they have received the alarm indication from the CMS 150, reset the panel, using the small screwdriver provided and test the next device.

7. Fill out an activation checklist indicating:

The name of the fire personnel activating the system.

The address of the system 19 placement.

The name and phone number of the contact person for the fire building.

The type and location of each device placed in service.

Verify that all detectors were tested and the system 19 signal was relayed to the local Fire Alarm Dispatch Center. This activation checklist should be forwarded to the Command center to facilitate the retrieval of the devices when the fire watch is terminated.

8. Notify Local Fire Alarm Dispatch Center of the system 19 activation address, that the testing mode is complete and that the system 19 is now monitoring the building. Instruct Local Fire Alarm Dispatch Center on the appropriate fire department response assignment if an alarm is received. Provide response instructions or hazard information depending on the incident. (Example: "The Portable Fire Alarm is being activated at 13 W. First Street. If you receive an alarm activation notice, dispatch a Special Duty Assignment to 13 W. First Street with one Company code two.")

2. Cellular Operations

The RAT portable, wireless, cellular fire alarm system 19 of the present invention will operate anywhere cellular phone service exists. It does not require a cellular service contract and cannot get a system busy signal. It does not use the voice channel of the cellular system, but it does use the digital control channel network. With this process, the RAT system 19 gets almost limitless nationwide coverage.

Figure 9:
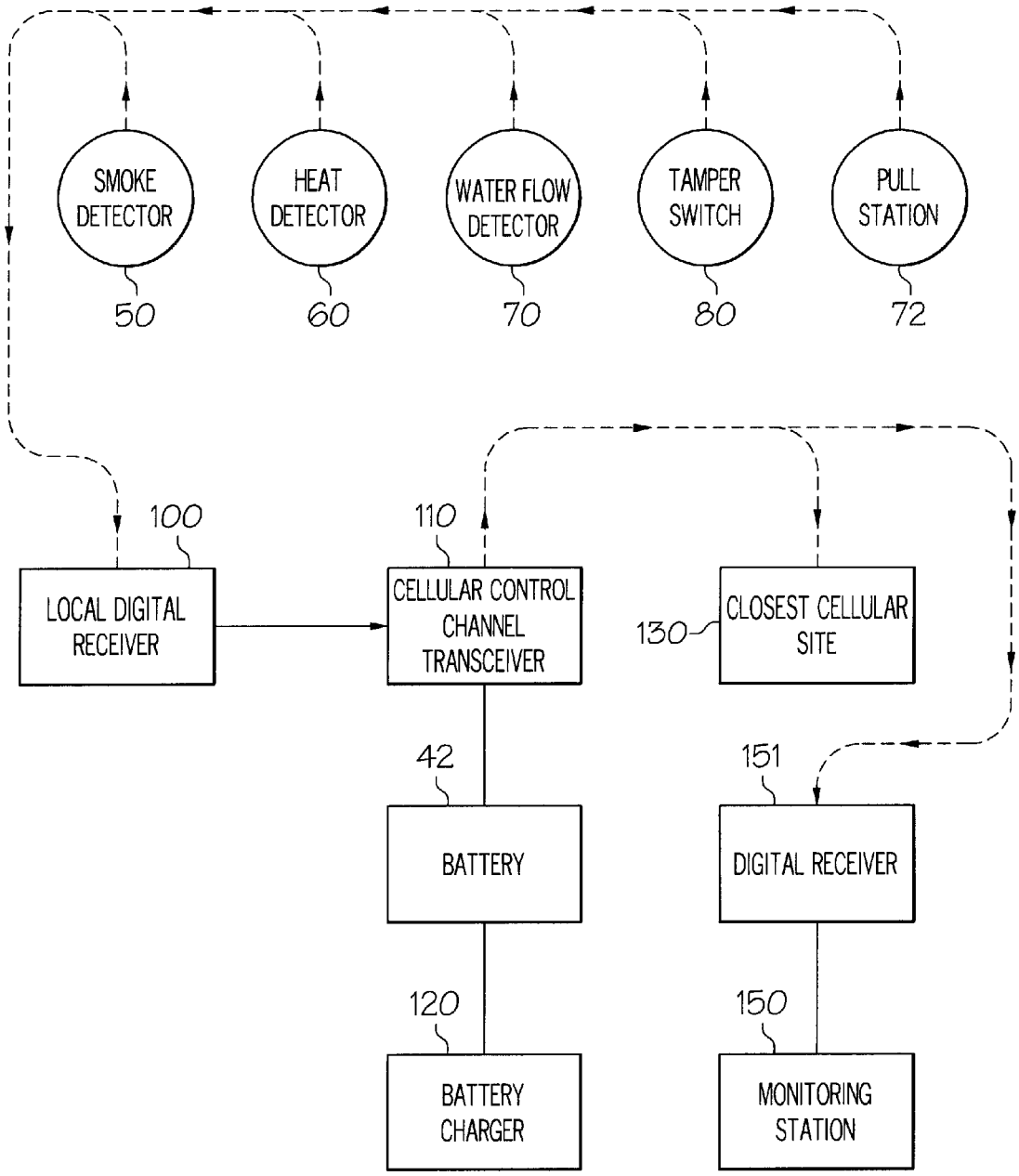
FIG. 9 is a schematic flow chart of the present invention.

As best seen in FIG. 9, this new type of two way cellular transmitter 110 communicates on the cellular telephone networks control channel, not the voice channels. There are no busy signals or dropped calls. It has no cellular phone number so no possibility of cloning or fraud. The control channel is faster than the cellular voice channel and provides stronger signal strength. All alarm packets are transmitted into the cellular networks control channel, where they are identified and routed to a Mobile Switching Center ("MSC") (not shown) via the nearest cellular control tower 130. The MSC logs status, checks and routes via RF to any properly equipped Central Monitoring Station("CMS") 150 in the country. There is no cellular phone call required and no busy signal conditions with which to deal. The cellular transmitter 110 will have virtually unlimited nationwide coverage and can roam to any place in the continental United States and function properly without any reprogramming.

3. The Cellemetry™ Protocols

On information and belief, the Cellemetry™ protocols were invented and are co-owned by BellSouth Corporation of Atlanta, Ga. and Numerex, Investment Corporation of Wilmington Del. and that technology is described and claimed in Roach U.S. Pat. No. 5,546,444, Roach U.S. Pat. No. 5,526,401, Barringer U.S. Pat. No. 5,675,371, Jehnert U.S. Pat. No. 5,822,423, and Comer U.S. Pat. No. 5,873,043. Applicant hereby incorporates by reference the entire disclosure of each of the aforesaid patents in their entirety as if set forth verbatim herein.

4. The MicroBurst™ Protocols

On information and belief, the MicroBurst™ protocols are under the control of Aeris Communications, Inc. ("Aeris") of San Jose Calif. and that technology is described and claimed in LaDue U.S. Pat. No. 5,889,474. Applicant hereby incorporates by reference the entire disclosure of the aforesaid patent in its entirety as if set forth verbatim herein.

Aeris explains the difference between the Cellemetry™ technology and the MicroBurst™ technology as follows:

On one hand, the Cellemetry™ technology involves a method which uses a control channel transaction, called a Feature Request, to transmit data to a local switch (MSC) and from the MSC to a localized user of the data.

On the other hand the MicroBurst™ technology uses a completely different control channel transaction known as a Remote Feature Control Request in its short-packet data and messaging processes. This difference causes the MSC to route the data payload beyond the local switching area, onto the backbone SS7 network and from there to the Aeris central hub facility for distribution via TCP/IP to its application customers. This unique MicroBurst™ system design supports automatic nationwide roaming of MicroBurst™ devices, allowing them to operate anywhere in the North American cellular footprint, a key benefit not available under the methods used in the Cellemetry™ technology. Aeris Communications, Inc., "Aeris Comment On Control Channel Data Technologies and Patents", News Release, Jun. 30,1998.

Excerpts From Further Current MicroBurst™ Technology Description and Benefits Presented on Aeris.com Aeris's patented MicroBurst™ technology utility is a proprietary method for sending short data packets over the control channels of existing cellular networks providing an economical conduit between the cellular telephone infrastructure and low-packet volume wireless data applications. For the MicroBurst™ service, Aeris contracts with cellular companies and then coordinates distribution channels (service providers with vertical market expertise) to take advantage of an evolving nationwide, virtual network.

Aeris maintains and operates the virtual network and a nationwide MicroBurst™ hub which acts as the network intelligence and provides wireless connectivity for a broad array of short packet signaling and messaging services including vehicle position and condition reporting, security and equipment monitoring and utility meter reading. Thus, companies can better allocate resources based on real-time information, offering customers nationwide service and automatic roaming between coverage areas of different carriers.

In addition, there's no cost implementation by cellular carriers, MicroBurst™ service requires no equipment add-ons, software patches or system upgrades of any kind; it offers cellular carriers an additional profit center without increasing congestion on the cellular network.

For any application requiring the transmission of only a small amount of information, MicroBurst™ service provides a low-cost, effective, reliable and nationwide solution.

Security Systems Monitoring

The addressable security alarm market consists of deployed systems that report status conditions to a monitoring center. An increasing proportion of the reporting alarm systems employ wireless backup to foil the cutting of telephone wires. The predominant wireless technology in current use for this purpose is circuit-switched cellular.

Equipment Monitoring

Operators of geographically dispersed, fixed location facilities, including vending machines, package drop boxes and gas pipelines, currently obtain information about status or condition—stocking, consumption (including packages in a drop box) and maintenance from actual visits by service personnel.

MicroBurst™ is a brilliant performer when customers need a low cost solution for monitoring their remote equipment. MicroBurst™ is a perfect exception-based reporter. The key is to provide only the information needed to make critical, daily decisions. And with MicroBurst™, machines can be placed anywhere throughout the US and MicroBurst™ will work.

MicroBurst's low monthly costs and single nationwide standard make the decision to go wireless simple.

MicroBurst™ devices send out cellular data messages using standard message protocols according to EIA/TIA-553 specifications. The data is encoded in the Dialed Digits field of the RECC packet as a Remote Feature Access Control request. This RECC transmission, containing MicroBurst data, is called a MicroBurst™ packet. This data packet is handled by the MSC (Mobile Switching Center) switches in the same way as any other control channel message originated by a mobile unit.

MicroBurst service operates completely within, and is transparent to, the current established cellular network, without usurping or compromising the voice-based infrastructure and revenue generation in any way. No significant capital outlays or system upgrades are required to support MicroBurst™ service.

To provide the necessary FOCC signaling, Roamer Ports are set up on the switch. Accessing the Roamer Port, and providing the MIN (Mobile Identification Number) of the device, allows the switch to send a cellular page to the MicroBurst™ device, and triggers the necessary responses in the device. This Roamer Port access is provided by cellular switch manufacturers.

In MicroBurst™- 1, the "downlink" is an eyelet trigger, essentially a call directed to the cellular device using standard FOCC signaling. The device treats this as an action "event", and initiates the return, or "uplink", of a MicroBurst™ packet using the RECC control channel. The MicroBurst packet contains the requested data from the cellular device.

MicroBurst devices use unique MIN numbers that do not conflict with voice cellular services or with landline telephone number. The NPA (Number Plan Area) field in the MIN is set to 175 for current MicroBurst™ devices. This allows the devices to be uniquely identified to the SS7 network, and also completely avoids various other cellular device problems such as wireless fraud. The 175 "area code" cannot be used to originate or receive traditional voice telephone calls, as this number cannot be dialed from landline connections.

To route the MicroBurst packet to Aeris over the SS7 network, the MSC switch translation tables are updated to add the DPC (Destination Point Code) of the Aeris hub systems that receive the data. This is normal activity for switch and network engineers who perform such functions for carriers.

The Dialed Digits field of the MicroBurst™ data packet begins with a single digit. This is a remote feature access digit, and the switch thus treats this message as a remote feature access request by a roamer cellular device.

Per the requirements of the EIA-553 and IS-41 standards, the switch routes the call data (in standard IS-41 format) out to the IS-41 network, using 8S7 protocols, for verification of features by an HLR, based on translation table assignments, the network address DPC (Destination Point Code) attached to the data packet causes the IS-41 message to be received at Aeris's special hub, a centrally located data processing center that handles MicroBurst™ packets.

This delivery of the call data is the essence of the MicroBurst™ data transmission that allows the transmitted data to be received by Aeris and then delivered to the Application Service Provider.

When the MicroBurst™ packet is received at Aeris, the special hub system extracts the data embedded in the Dialed Digits field. The data is then executed upon according to the application requirements. For example, the data thus acquired can be transferred to a local computer system for further processing by the application, typically, the data will be sent to an Applications Service Provider.

Since there is no requirement for the MSC and Base Site to assign a reverse voice channel, the Aeris hub system requests the cellular switch to terminate the call without requiring voice channel access by the mobile unit. Since all the required data is transmitted within the initial control channel data packet, no further interaction with the mobile unit is necessary.

In some applications, a mobile device may initiate a data transmission without the need for an external FOCC event trigger. These devices do not necessarily require triggers, since the specific application parameters are such that the mobile device can determine the need for the action. For example, a GPS (Global Positioning System) equipped vehicle may report its position based on pre-programmed conditions coming true at the mobile.

Using the control channels for data has significant advantages over the voice channels—the control channels are robust enough to work where voice channels may be unusable. They are underutilized, and lend themselves for other applications without impacting the voice cellular system.

The robustness of the control channels is achieved by various methods. First and foremost, they are digital data channels and are broadcast at the maximum allowed radio frequency power allowed for the cellular system. Each word in the transmission is repeated multiple times (even though they include parity bits) for majority voting at the cellular base stations, to ensure that the correct information is received at the cellular switch.

The RECC (Reverse Control Channel) used when sending data from the MicroBurst™ device to the host control channel capacity is greatly underutilized. In high-density urban areas, when the normal voice channels are used to maximum capacity, the RECC control channels are generally below 10% of total available capacity. In the forward direction, the FOCC (Forward Control Channel) used when sending data triggers from the host to the MicroBurst device control channels are more used. However, MicroBurst™ applications are focused primarily on data transmissions from the MicroBurst™ device using the RECC, and use of the FOCC is limited to occasional event triggers.

After the MicroBurst™ data packets are received at the Aeris hub, the MIN, ESN and Dialed Digits are extracted from the data packet. The MIN and ESN information is examined by the hub routines, and appropriate validation of the account is provided via the SS7 network to the origination point of the remote feature request.

The MIN, ESN and Dialed Digits are then sent to a Message Router at Aeris that determines the destination of the data, and transmits this data to an Application Service Provider for all subsequent processing. Although not shown, the Message Router and various data spooler processes also log the data for billing and tracking purposes. Aeris intends to provide tools for visibility into the data log for Applications Service Providers and Cellular Carriers who desire this capability.

The medium and method for this data delivery to the Application Service Provider can be chosen from a variety of possibilities that are application dependent. For example, in the case of a Two-Way Paging/Messaging Application, the data in the Dialed Digits field can be used to initiate a PSTN call to an individual and play a voice message from an IVR (Interactive Voice Response) system. For other applications, or where the Application Service Provider chooses to make the final data disbursement to their customers, the data is transmitted to them using TCP network protocols via encrypted TCP socket-to-socket connections over the Internet or dedicated TCP point-to-point network connections.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A portable wireless fire alarm system, comprising:

a portable enclosure;

a wireless receiver adapted to receive an alarm signal from at least one zone at a structure being monitored, said wireless receiver secured within said enclosure; and a cellular transceiver secured within said enclosure and in communication with said wireless receiver and independent of any hard-wired telephone lines connected to said structure, said cellular transceiver constructed and configured to initiate and complete a wireless transmission, when said receiver receives said signal, on the control channel of a cellular network using a MicroBurst™ remote feature control request control channel transaction to a location apart from said structure.

2. The apparatus of claim 1 wherein the enclosure is watertight.

3. The apparatus of claim 1 wherein the call is the transmission of a fire alarm.

4. The apparatus of claim 1 wherein the call is completed without the use or assistance of a user interface.

5. The portable alarm system of claim 1 wherein said enclosure is a suitcase having a body portion, a lid and latches for securing the lid to the body and made from injection molded polycarbonate/ABS plastic thereby providing shock resistance.

6. The portable alarm system of claim 1 wherein said enclosure is of a color that is very conspicuous and obvious.

7. The portable alarm system of claim 6 wherein said color is bright orange.

8. The portable alarm system of claim 1 wherein said alarm signal from said at least one zone is generated by a device selected from the group consisting of a smoke detector, a heat detector, a tamper detector, a water flow detector, and a fire pull station.

9. A method of reporting a fire alarm in a cellular network having voice and control channels comprising the steps of:

deploying a plurality of detectors, each connected to an independent short range wireless transmitter;

detecting an alarm condition at one of the plurality of detectors and transmitting a detection signal to a receiver enclosed in a rugged, watertight enclosure; and transmitting the detection signal from a cellular transceiver enclosed in the rugged watertight enclosure over the control channel of a cellular network using a MicroBurst™ protocol.

10. The method of claim 9 wherein the MicroBurst™ protocol is a Remote Feature Control Request control channel transaction.

11. The method of claim 9 further comprising the step of carrying out the transmitting step without the aid or assistance of a user interface.

12. The method of claim 9 wherein the rugged, watertight enclosure bears a conspicuous bright orange color.

* * * * *